US005433351A

United States Patent [19]

Okuyama et al.

[11] Patent Number: 5,433,351

[45] Date of Patent: Jul. 18, 1995

[54] CONTROLLED LIQUID DISPENSING APPARATUS

[75] Inventors: Hidenori Okuyama; Tomonobu Tomita; Takeyuki Satoh, all of Yokkaichi, Japan

[73] Assignee: Misuzuerie Co., Ltd., Yokkaichi, Japan

[21] Appl. No.: 48,884

[22] Filed: Apr. 16, 1993

[30] Foreign Application Priority Data

May 1, 1992 [JP] Japan ..... 4-112658
Jun. 29, 1992 [JP] Japan ..... 4-170971

[51] Int. Cl.[6] ..... B65D 37/00

[52] U.S. Cl. ..... 222/214; 222/333; 417/413.2

[58] Field of Search ..... 222/333, 207, 214; 417/413 A, 413 B, 413 R, 332, 478, 482

[56] References Cited

U.S. PATENT DOCUMENTS

| | | | |
|---|---|---|---|
| 3,089,622 | 5/1963 | Westlake, Jr. | 222/214 X |
| 4,256,242 | 3/1981 | Christine | 222/214 X |
| 4,261,356 | 4/1981 | Turner et al. | 222/207 X |
| 4,344,743 | 8/1982 | Bessman et al. | 417/413 A X |
| 4,463,876 | 8/1984 | Swallert | 222/214 |
| 4,515,294 | 5/1985 | Udall | 222/214 X |
| 4,519,792 | 5/1985 | Dawe | 417/413 R X |
| 4,520,948 | 6/1985 | Hampel et al. | 222/207 X |
| 4,545,735 | 10/1985 | Ims | 417/413 R X |
| 4,715,517 | 12/1987 | Potter et al. | 222/214 X |
| 4,974,754 | 12/1990 | Wirz | 222/207 |
| 5,085,562 | 2/1992 | van Lintel | 417/413 A X |
| 5,205,819 | 4/1993 | Ross et al. | 417/413 A X |

FOREIGN PATENT DOCUMENTS

| | | | |
|---|---|---|---|
| 0053813 | 6/1982 | European Pat. Off. . | |
| 0333305 | 9/1989 | European Pat. Off. . | |
| 0398583 | 11/1990 | European Pat. Off. . | |
| 0435653 | 7/1991 | European Pat. Off. . | |
| 3926348 | 3/1990 | Germany . | |
| 0285681 | 11/1989 | Japan | 417/413 A |

*Primary Examiner*—Kevin P. Shaver
*Attorney, Agent, or Firm*—David O'Reilly

[57] ABSTRACT

A liquid feeding and dispensing apparatus having a disposable whole liquid container unit that can be immersed in a sterilizing tank for cleaning. The liquid container unit has an elastic liquid container, a pump, and valves integrated therein that is separate from a holder unit for driving a pump. The liquid container unit has an expansible liquid container filled with a liquid, a liquid feeder connected with an outlet from the liquid container at one end, and a pump chamber having one end connected with the other end of the liquid feeder. The pump chamber has a flexible wall plate, and a feeding tube connects with an outlet end of the pump chamber. A pump holder unit has a pump drive body detachably holding the pump chamber for deviating or flexing the flexible wall plate to change the volume of the pump chamber. A pinch valve has a groove for inserting and receiving the feeding tube to pinch the feeding tube closed when not feeding the liquid. In an alternate embodiment the pump chamber is sealed by a projection on the inside of the flexible wall plate.

6 Claims, 4 Drawing Sheets

CONTROLLED LIQUID DISPENSING APPARATUS

FIELD OF THE INVENTION

The present invention relates to a liquid feeding apparatus. More particularly, it concerns a liquid feeding apparatus, such as a liquid dispenser, for liquid foods, including coffees, juices, teas, soups, liquid medicines, and similar liquids.

BACKGROUND OF THE INVENTION

Heretofor, conventional liquid feeding apparatuses of this type are constructed of a liquid container unit for storing condensed coffee, juice, or similar condensed liquids or liqueurs, a liquid feeder connected with the liquid container unit, and an electromagnetic valve provided for the liquid feeder. A feeding on-off switch is turned on to feed the liquid. The liquid should be added with a desired amount of cold or hot water as required. Such conventional apparatuses have a timer to control the feeding on-off switch for a specific period of time for a desired amount of the liquid.

However, the conventional liquid feeding apparatuses have the disadvantage that an actual feed of the liquid is changed according to the amount of liquid remaining in the liquid container even when tile feeding on-off switch is set to turn off. This is because the liquid is made to drop free to the feeding tube from the liquid container.

BRIEF DESCRIPTION OF THE INVENTION

In view of the foregoing, it is an object of the present invention to provide a liquid feeding apparatus which is capable of making the amount of a liquid fed constant irrespective of the liquid remaining in a liquid container. Another object of the present invention is to provide a liquid feeding apparatus which allows the liquid to be supplied and replaced easily and sanitarily.

Briefly, the foregoing objects are accomplished in accordance with aspects of the present invention by a liquid feeding apparatus comprising in combination: a liquid container unit A having a liquid container 1 filled with a liquid, a liquid feeder 1*a* connected with the liquid container 1 at one end, a pump chamber 5 having one end connected with the other end of the liquid feeder 1*a*, the pump chamber 5 having a flexible wall plate 2*a*, and a feeding tube 9 connected with the other end of the pump chamber 5. Holder unit B has pump drive body 6 for detachably holding pump chamber 5 for deviating flexible wall plate 2*a* to change the volume of pump chamber 5. A protection tape of a surface fastening member 7*a*, such as double-side sticking tape or surface fastener, of pump body 2 of the liquid container unit A should be peeled off to expose the sticking surface. Surface fastening member 7*a* should be put into pump drive body 6 of a holder unit B before a flexible wall plate 2*a* is coupled with drive member 7. If the pump drive body 6 is turned on, then drive member 7 drives the wall plate 2*a* through the surface fastening member 7*a*. This makes pump chamber 5 expand and contract to operate the pump body 2 to feed a predetermined amount of liquid.

Briefly, the foregoing objects are accomplished in accordance with aspects of the present invention by a liquid feeding apparatus comprising in combination: a liquid container unit A having a liquid container 1 filled with a liquid, a liquid feeder 1*a* connected with the liquid container 1 at one end, a pump chamber 5 having one end connected with the other end of the liquid feeder 1*a*, the pump chamber 5 having a flexible wall member 2*a*. A projection 2*b* is provided inside the flexible wall member 2*a* for making back pressure of the pump chamber 5, and a feeding tube 9 connected with the other end of the pump chamber 5 high. Holder unit B has a pump drive body 6 for detachably holding the pump chamber 5 and for deviating the flexible wall member 2*a* to change the volume of pump chamber 5 and a groove 11*a* for inserting feeding tube 9 thereinto. A protection tape of a surface fastening member 7*a*, such as double-side sticking tape or a surface fastener, of pump body 2 of liquid container unit A should be peeled off to expose the sticking surface. The surface fastening member 7*a* should be put into pump drive body 6 of holder unit B before flexible wall member 2*a* is coupled with drive member 7. If the pump drive body 6 is turned on, then the drive member 7 drives the wall member 2*a* through surface fastening member 7*a*. This makes pump chamber 5 expand and contract to operate the pump body 2 to feed a predetermined amount of liquid.

Thus, the liquid cannot leak by gravitation (head pressure) exerted on the liquid in the liquid container even if the cover 8 is open. This is because the back pressure is higher. For this reason, there is no need to provide such additional devices as the pinch valve for pinching the feeding tube to prevent liquid from leaking. This can result in lower cost and simplified attaching and detaching procedures. It also allows replacement of the liquid container without contaminating the circumference. It further allows feeding a predetermined amount of liquid irrespective of the liquid level in the liquid container.

The above and other objects, advantages and novel features of this invention will be more fully understood from the following detailed description and the accompanying drawings, in which like reference numbers indicate like or similar parts throughout wherein;

DETAILED DESCRIPTION OF THE INVENTION

First embodiment

Figure 1:
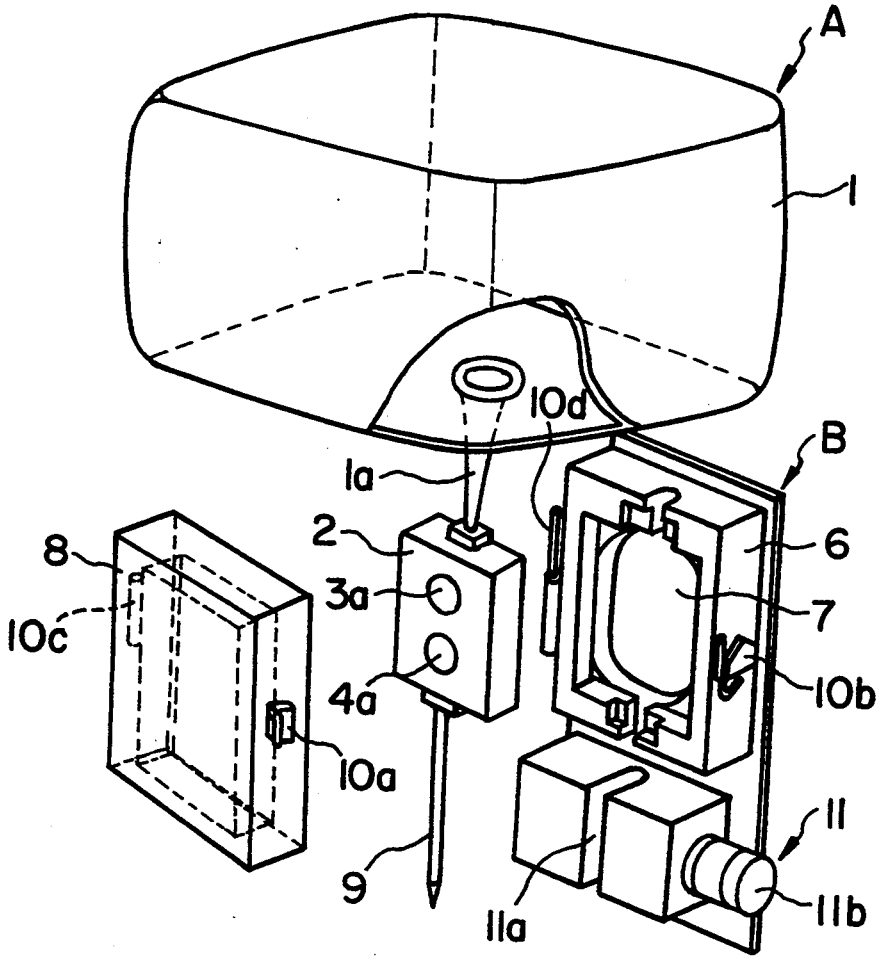
FIG. 1 shows an exploded perspective view for major parts of a liquid feeding apparatus and an vending machine in one embodiment according to the present invention.
Figure 2:
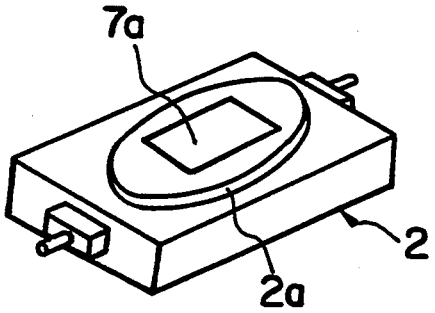
FIG. 2 is a perspective view of a pump 2 for the liquid feeding apparatus.

A liquid container unit A is formed of a liquid container 1 filled with a liquid, a rectangular pump body 2 is connected with liquid container 1 through liquid feeder 1*a*, and a feeding tube 9 is connected with pump body 2. The pump body 2 has a sucking check valve 3 and a feeding check valve 4 provided on its suction side and feeding side, respectively. The pump body 2 also has a pump chamber 5 sealed by flexible wall plate 2a inside the sucking check valve 3 and the check valve 4, its capacity being changeable.

Figure 3:
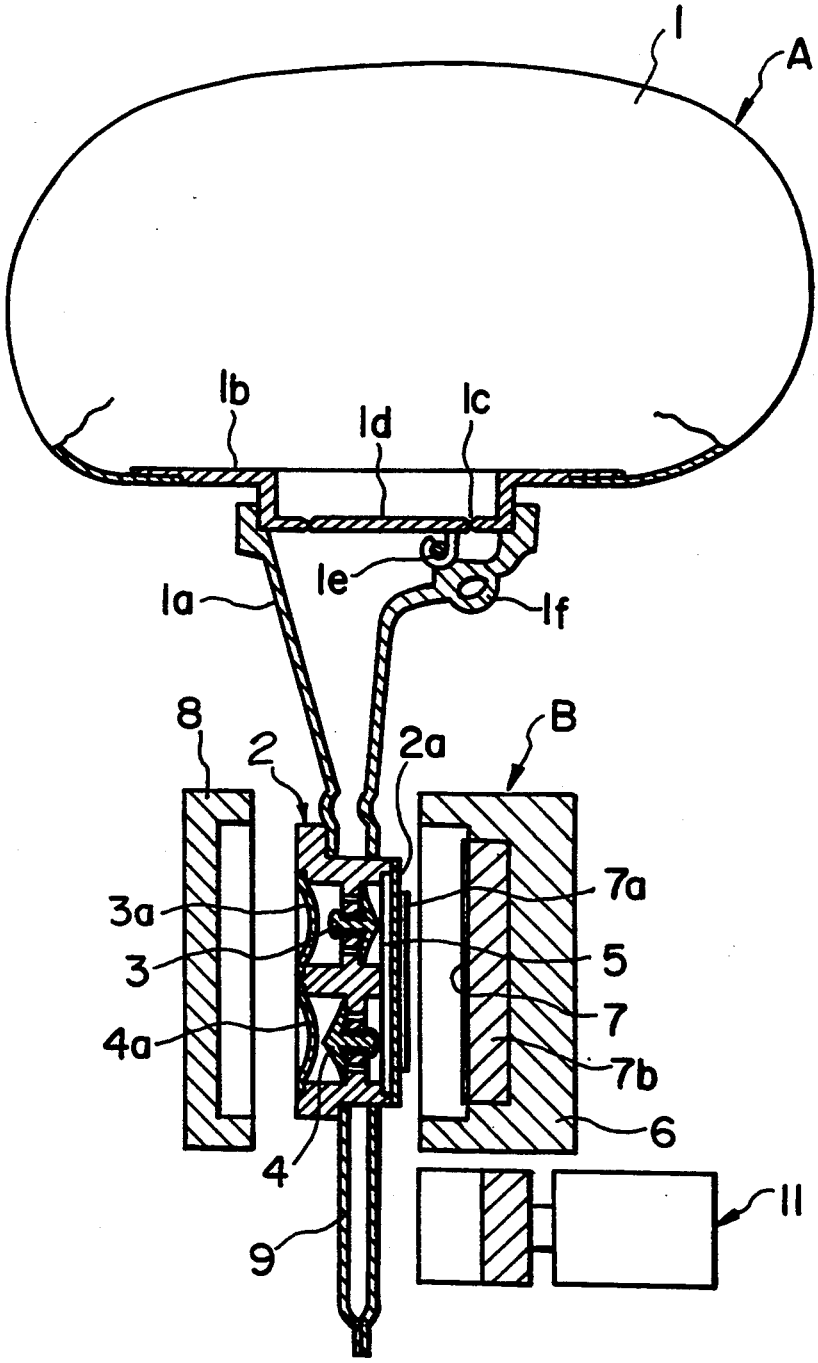
FIG. 3 is a longitudinal cross-sectional view of the major parts of the apparatus of FIG. 2.

The liquid container 1, as shown in FIG. 1, is an elastic bag that is expandable to a rectangular shape. The liquid container 1, as shown in FIG. 3, has a closing vinyl plate 1b at its opening connected with liquid feeder 1a. Vinyl plate 1b is connected with lid 1d by notch 1c. The lid 1d is coupled with an outside tip 1f by a hook and a pin 1e. For operation, the liquid inside the liquid container 1 is fed into liquid feeder 1a when tip 1f is pulled outward to tear it off. The liquid feeder 1a for supplying the liquid is filled with an inert gas, such as nitrogen gas.

As mentioned above, the pump body 2 comprises check valve 3 communicating with liquid container 1 on its intake side and check valve 4 communicating with feeding tube 9 of soft resin on its feeding side. The check valve 3 and check valve 4 are directed opposite to each other, and sides opposite to their respective diaphragms 3a and 4a communicate with pump chamber 5. The feeding tube 9 is heat sealed at its end and is cut off for use.

The flexible wall plate 2a available outside pump chamber 5 is, for example, of polyethylene terephthalate.

A holder unit B is formed of a cover 8, a pump drive body 6 fitting against and detachably containing pump body 2, a drive member 7 for driving flexible wall plate 2a of the pump body 2, and pinch valve 11.

The drive member 7 for the pump drive body 6 is made, for example, of stainless steel plate. The drive member 7 is detachably fitted to flexible wall plate 2a for the pump chamber 5 through surface fastening member 7a, such as double-side slicking tape or surface fastener, to increase its drive efficiency. The bonding force of surface fastening member 7a is selected so that the tape cannot remain if surface fastening member 7a is removed. If the double-side sticking tape is used, for example, the bonding force of the side of the surface fastening member 7a applied to the drive member 7 is made weak. The drive member 7, as shown in FIG. 3, has a pump actuator 7b of piezoelectric material fixed to a rear side thereof. The drive member 7 generates a drive force of an alternating voltage applied to the pump actuator 7b.

Also in FIG. 1 locks 10a and 10b close and lock cover 8 on hinges 10c and 10d.

Pinch valve 11 is provided below the pump drive body 6 to pinch and close feeding tube 9. Pinch valve 11 has a groove 11a for inserting feeding tube 9 and closed an electromagnetic device 11b for pinching the feeding tube 9.

In turn, the following describes how the liquid feeding apparatus operates.

Figure 5:
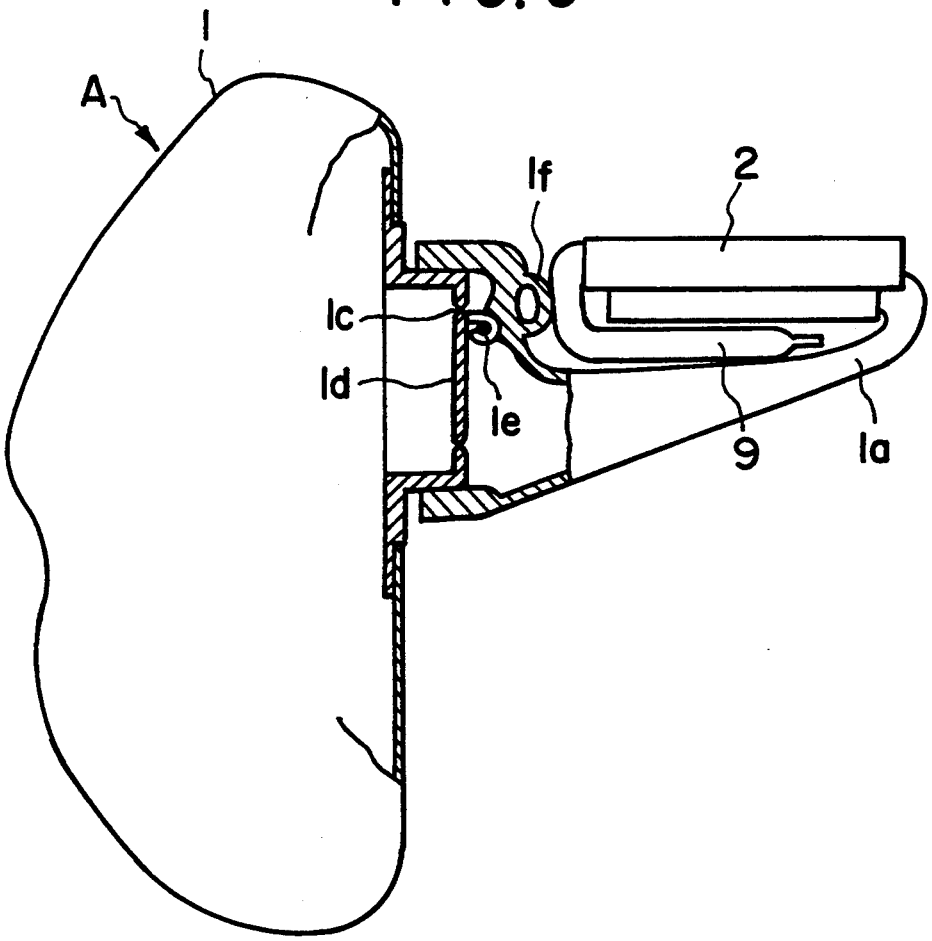
FIG. 5 is a longitudinal cross-sectional view of the liquid container unit folded for packing.

As shown in FIG. 5, liquid feeder 1a and feeding tube 9 is folded in and pump body 2 is overlapped thereon to pack the liquid container unit A in a box or the like before it is transported.

Figure 4:
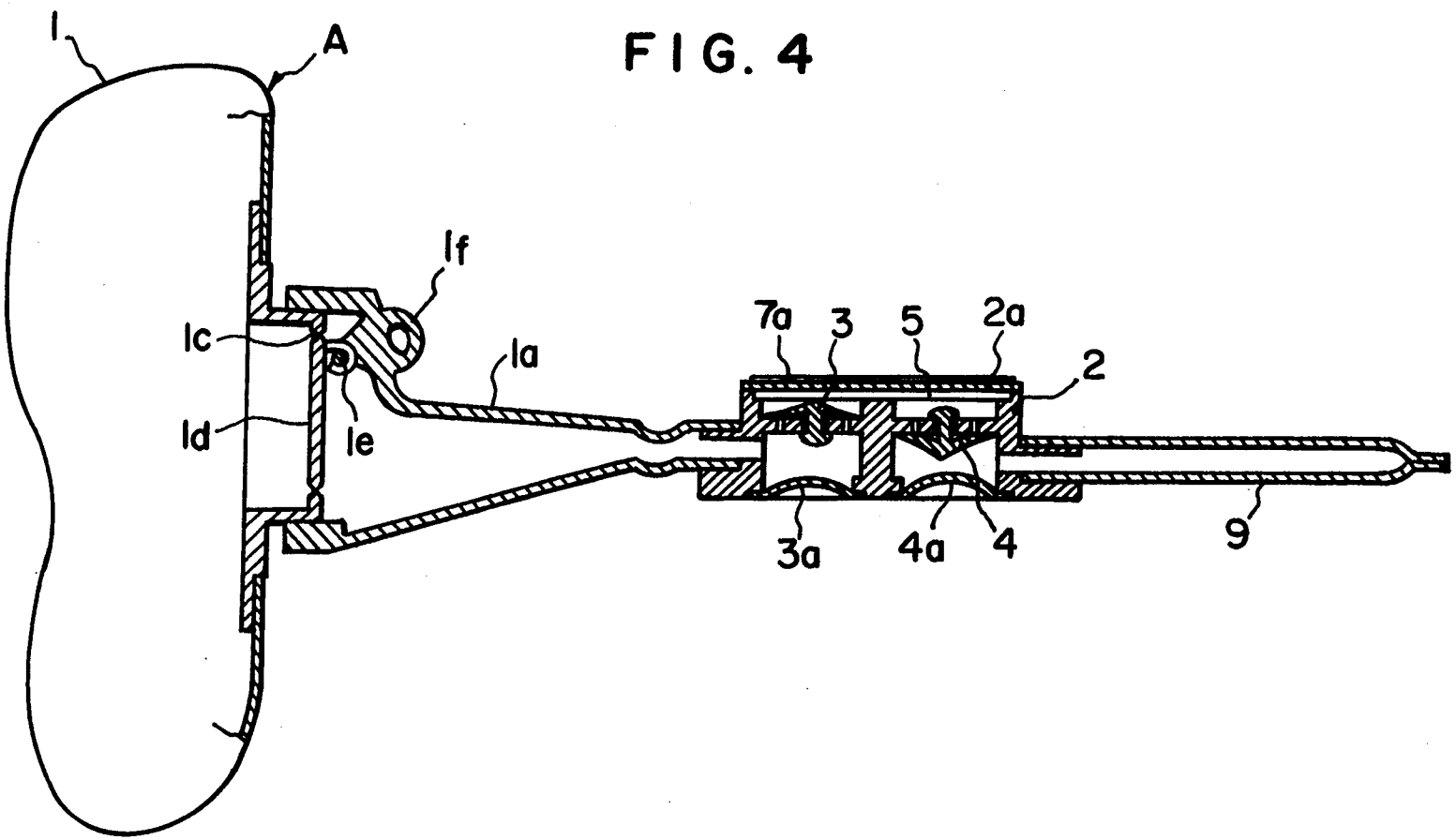
FIG. 4 is a longitudinal cross-sectional view of a liquid container unit with the liquid fed out.

For use of the liquid container unit A, as shown in FIG. 4, all the parts of the liquid container unit A are unfolded.

A bonding surface is exposed by peeling the protection tape off from the surface of fastening member 7a provided on flexible wall plate 2a of the pump body 2 of the liquid container unit A. The surface fastening member 7a is inserted in the pump drive body 6 of the holder unit B to stick flexible wall plate 2a to drive member 7.

At the same time, feeding tube 9 is inserted into groove 11a. Finally, the cover 8 should be closed before locks 10a and 10b are secured.

To open lid 1d, the tip 1f is pulled out to break notch 1c. The liquid in the liquid container 1 will flow into the pump body 2. The liquid pressure expands diaphragm 3a opposite check valve 3. In turn, the feeding tube 9 is clipped off at its end using a pair of scissors. In this instance, the liquid cannot feed out as the pinch valve 11 is pinching feeding tube 9 closed.

To feed the liquid, the pinch valve 11 is opened. The pump actuator 7b should be driven. Vibration of the pump actuator 7b drives the flexible wall plate 2a to expand and contract the pump chamber 5. Adjusting the drive time of the pump actuator 7b can feed a desired amount of the liquid from the feeding tube 9. After this, the pump actuator 7b is stopped. At the same time, the pinch valve 1 is closed to pinch feeding tube 9 to prevent the liquid from leaking.

If the liquid is all consumed, the whole liquid container unit A is discarded and replaced.

The pump actuator 7b can be made of any available piezoelectric materials, electrostriction materials, magnetostriction materials, and similar materials that can be deformed or volume-changed by application of an electric or magnetic field.

As described so far, the liquid feeding apparatus of the present invention has the advantage that the pump always feeds a predetermined quantity of tile liquid irrespective of the remaining amount. Also, the apparatus also has the advantage that the whole liquid container unit can be immersed in a sterilizing tank for cleaning. This is because liquid container unit A having tile liquid container, the pump, and the valves integrated therein are separate from holder unit B for driving the pump. Further, the apparatus being disposable is sanitary and easy to use.

Further more, the apparatus has the advantage that the liquid container unit A having no electric parts can be manufactured at low cost. It should be noted that the surface fastening member used in the embodiment described above is not always required if the pump drive body can efficiently transmit its vibration to the wall surface of the pump chamber, although it is used in the embodiment described above.

In said apparatus according to first embodiment, for feeding the liquid, the liquid container should be replaced. To attach or detach the liquid container, while the electromagnetic pinch valve (automatic pinch valve) is closed to pinch feeding tube 9, the following procedures should be performed.

(1) Locks 10a and 10b for the pump drive body 6 should be unlocked.

(2) Cover 8 should open.

(3) The pump body 2 should be removed from pump drive body 6, with the surface fastening member 7a detached.

(4) The feeding tube 9 should be removed from groove 11a of the pinch valve.

(5) The old liquid container 1 should be removed.

(6) The old liquid container 1 should be discarded.

(7) A new liquid container 1 should be set in place.

(8) In outside tip should be pulled out to allow the liquid to be fed to the liquid feeder 1a.

(9) The pump body 2 should be set in pump drive body 6 and the flexible wall plate 2a of pump body 2 should be coupled with drive member 7 through the surface fastening member 7a.

(10) The feeding tube 9 should be inserted into the groove 11a of the pinch valve.

(11) The cover 8 should be closed, and locks 10a and 10b should be locked.

(12) The tip of the feeding tube 9 should cut off.

The liquid feeding apparatus according to first embodiment, as described above, has the disadvantage that it is hard to attach or detach feeding tube 9 as the attachment or detachment is made with the pinch valve closed. If the attachment or detachment is done with the pinch valve open, however, this causes a problem that the liquid may leak. For ressolving the problem second embodiment is proposed, Second embodiment The following describes a second embodiment of the present invention shown in FIG. 6 in which identical reference numbers are used for identical parts in the above first embodiment.

Figure 6:
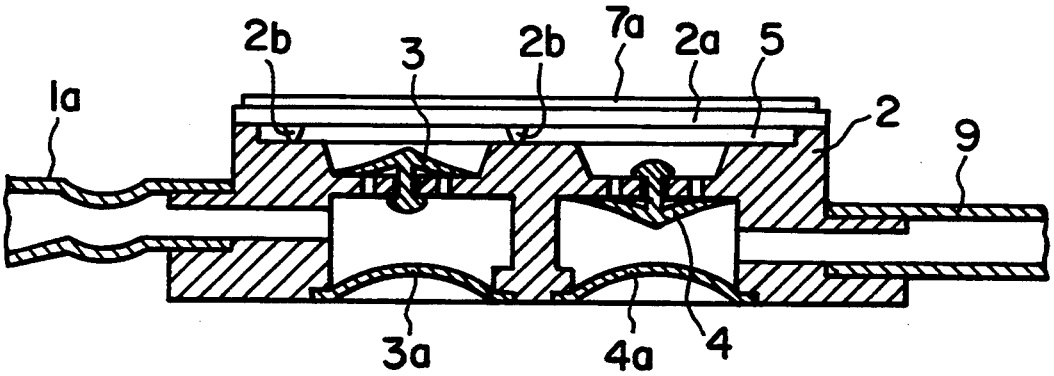
FIG. 6 is an enlarged longitudinal cross-sectional view of a pump chamber 5 as one of the major parts of the pump 2 in a second embodiment according to tile present invention.

A liquid container unit A is formed of a liquid container 1 filled with a liquid, rectangular pump body 2 connected with liquid container 1 through a liquid feeder 1a, and a feeding tube 9 connected to pump body 2. The pump body 2 has a sucking check valve 3 and a feeding check valve 4 provided on its suction side and feeding side, respectively. The pump body 2 also has a pump chamber 5 sealed by flexible wall plate 2a adjacent the sucking check valve 3 and the check valve 4, its capacity being changeable. As shown in FIG. 6, flexible wall member 2a has a projection 2b formed inside thereof to contact around the periphery and enclose sucking check valve 3.

The projection 2b has a clearance set to be able to close around the sucking check valve 3 during the feeding process when flexible wall member 2a is vibrated.

The liquid container 1, as shown in FIG. 1, is an elastic bag that is expandable to a rectangular shape. The liquid container 1 has a closing vinyl plate 1b on its opening connected with liquid feeder 1a. The vinyl plate 1b is connected with a lid 1d by notch 1c. The lid 1d is coupled with an outside tip 1f by a hook and a pin similar to that shown in FIG. 3. For operation, the liquid inside the liquid container 1 is fed into feeder la by pulling tip 1f out to tear off lid 1d. The liquid feeder 1a for supplying the liquid is filled with an inert gas, such as nitrogen gas.

As mentioned above, the pump body 2 comprises the check valve 3 communicating with liquid container 1 on its intake side and the check valve 4 communicating with feeding tube 9 of soft resin on its feeding side. The check valve 3 and check valve 4 are directed opposite to each other, and the sides opposite to their respective diaphragms 3a and 4a communicate with pump chamber 5 tube 9 is heat sealed at its end and is cut off for use. The feeding The flexible wall member 2a available outside the pump chamber 5 is, for example, a film of polyethylene terephthalate resin.

A holder unit B is formed of a cover 8, a pump drive body 6 fitting against and detachably containing pump body 2, and a drive member 7 for driving the flexible wall member 2a of the pump body 2.

The drive member 7 for the pump drive body 6 is made, for example, of stainless steel plate. The drive member 7 is detachably fitted to flexible wall member 2a for pump chamber 5 through a surface fastening member 7a, such as double-side sticking tape or surface fastener, to increase its drive efficiency. The bonding force of the surface fastening member 7a is selected so that the tape cannot remain if the surface fastening member 7a is removed. If double-side sticking tape is used, for example, the bonding force of the side of the surface fastening member 7a applied to the drive member 7 is made weak. The drive member 7 has a pump actuator 7b of piezoelectric material fixed to a rear side thereof. The drive member 7 generates a drive force of an alternating voltage applied to the pump actuator 7b.

Also in FIG. 1 locks 10a and 10b close and lock the cover 8 on hinges 10c and 10d.

Groove 11a is provided below the pump drive body 6 to receive the feeding tube 9.

In turn, the following describes how the liquid feeding apparatus operates.

The liquid feeder la and the feeding tube 9 is folded in and the pump body 2 is be overlapped thereon to pack the liquid container unit A in a box or the like before it is transported.

For use of the liquid container unit A, all the parts of the liquid container unit A are unfolded.

A bonding surface is exposed by peeling the protection tape off from the surface fastening member 7a provided on flexible wall member 2a of the pump body 2 of the liquid container unit A. The surface fastening member 7a is inserted in the pump drive body 6 of holder unit B to stick flexible wall member 2a to drive member 7.

At the same time, feeding tube 9 is inserted into groove 11a. Finally, the cover 8 should be closed before locks 10a and 10b are secured.

To open lid 1d, tip 1f is pulled out to break connection 1c. The liquid in the liquid container 1 will flow into the pump body 2. The liquid pressure expands diaphragm 3a opposite check valve 3. In turn, the feeding tube 9 is clipped off at its end using a pair of scissors. In this instance, the liquid cannot feed out as the pump body 2 is closed by the contact of the projection 2b against the periphery around check valve 3 due to the pressing force of flexible wall member 2a of the pump body 2 against the valve side stuck to drive member 7.

Thus, if the pump is not driven, projection 2b closing around sucking check valve 3 can be made to lightly contact and seal the wall around the sucking check valve 3, thereby preventing liquid from leaking.

To feed the liquid, pump actuator 7b is driven. The pump actuator 7b vibrates driving flexible wall member 2a through the surface fastening member 7a to expand and contract pump chamber 5. If the drive time for pump actuator 7b is preset to a fixed period, feeding tube 9 feeds a certain amount of the liquid. At the same time, the pump body 2 is closed to increase back pressure of pump chamber 5 in non-operation, thereby preventing liquid from leaking. The back pressure should be a value at which pump body 2 will not be allowed to open when the liquid level of the liquid container 1 is below 300 mm high as it is 300 mm high at maximum. If the flow paths of the check valve 3 and the check valve 4 can be shut off, the shape and position of projection 2b can be determined as desired.

If the liquid is all consumed, the whole liquid container unit A should be discarded and replaced.

The pump actuator 7b available can be made of any available piezoelectric materials, electrostriction materials, magnetostriction materials, and similar materials that can be deformed or volume changed by application of an electric or magnetic field.

In the embodiment described above, the back pressure of pump chamber 5 is made higher with projection 2b in contact around the periphery of sucking check valve 3. Instead, the back pressure of the pump chamber 5 can be made higher with the projection 2b contacting a suction hole of the feeding check valve. Further, it can be made to a selected a desired position in the flow path from the sucking valve to the feeding valve to provide alternative higher back pressure at the position.

As described so far, the liquid feeding apparatus of the present invention has the advantage that the pump can always feed a predetermined quantity of the liquid irrespective of the remaining amount. Also, the apparatus also has the advantage that the whole liquid container unit can be immersed in a sterilizing tank for cleaning. This is because liquid container unit A having the liquid container, the pump, and the valves integrated therein is separate from holder unit B for driving the pump. Further, the apparatus being disposable is sanitary and easy to use.

More further, the apparatus has the advantage that the liquid container unit A having no electric parts, can be manufactured at low cost. It should be noted that the surface fastening member used in the embodiment described above can be replaced by a different construction if the pump drive body can efficiently transmit its vibration to the wall surface of the pump chamber, although it is used in the embodiment described above.

Still further more, the apparatus has the advantage that the liquid cannot leak by the force of gravitation (head pressure) exerted on the liquid in the liquid container even if cover 8 is opened for attaching or detaching the liquid container. This is because the back pressure is higher. For this reason there is no need to provide such additional devices as the pinch valve for pinching the feeding tube to prevent liquid from leaking. This can result in lower cost and simplified attaching and detaching procedures. It also allows replacement of the liquid container without contaminating the circumference. It further allows feeding a predetermined amount of liquid irrespective of the liquid level in the liquid container.

This invention is not to be limited to the embodiments shown in the drawings and described in the description which is given by way of example and not of limitation, but only in accordance with the scope of the appended claims.

What is claimed is;

1. A liquid feeding apparatus comprising in combination;

(1) a liquid container unit having a liquid container filled with a liquid, a liquid feeder connected with said liquid container at its one end, a pump chamber, one end of said pump chamber being connected with the other end of the liquid feeder, said pump chamber having a flexible wall member, an inlet check valve, an outlet check valve, and projection means on an inside surface of said flexible wall member sealing around at least one periphery of said inlet check valve and said outlet check valve when said flexible wall member is flexed for creating a higher back pressure in the pump chamber, and a feeding tube connected with the other end of the pump chamber; and (2) a holder unit having a pump drive body for detachably holding said pump chamber, pump drive means for flexing said flexible wall member to change the volume of said pump chamber and a groove for inserting said feeding tube thereinto.

2. The apparatus according to claim 1 including pinch means to pinch said feeding tube inserted in said groove closed when said pump drive body is deactivated and release said feeding tube when said pump drive body is activated.

3. The liquid feeding apparatus claimed in claim 2, including surface fastening means provided on at least one surface of an outer surface of said flexible wall member and the outer surface of said pump drive body for detachably fastening said flexible wall member to said pump drive body without penetrating said flexible wall member.

4. A liquid feeding and dispensing apparatus comprising;

a liquid container unit comprised of a liquid container for holding a liquid, liquid feeding means connected to an outlet on said liquid container, pump means having a pumping chamber connected to the other end of said liquid feeding means, said pumping chamber including a flexible wall member, an outlet check valve and an inlet check valve, projecting means on an inside surface of said flexible wall member sealing around at least one periphery of said inlet check valve and outlet check valve when said flexible wall member is flexed for creating a back pressure in said pumping chamber, and a feeding tube connected to an outlet end of said pumping chamber; and holding unit means comprised of a pump drive body for detachably holding said pump chamber, said pump drive body including means for flexing said flexible wall member to change the volume of said pumping chamber and a groove for receiving and inserting said feeding tube.

5. The apparatus according to claim 4 including pinch means to pinch said feeding tube inserted in said groove closed when said pump drive body is deactivated and release said feeding tube when said pump drive body is activated.

6. The apparatus according to claim 5 including surface fastening means provided on at least one surface of the outer surface of said flexible wall member and the outer surface of said pump drive body for detachably fastening said flexible wall member to said pump drive body without penetrating said flexible wall plate.

* * * * *